United States Patent [19]

Grenzendoerfer et al.

[11] Patent Number: 4,638,647

[45] Date of Patent: Jan. 27, 1987

[54] METHOD AND FLAT WARP-KNITTING MACHINE FOR THE PRODUCTION OF A WEFT-AND-WARP-KNIT FABRIC

[75] Inventors: Dietmar Grenzendoerfer; Achim Wierzgon, both of Karl Marx Stadt; Gerhard Mueller, Garnsdorf; Dieter Erth, Gruena; Ludwig Guenther, Karl Marx Stadt; Rolf Kuenzel, Gelenau, all of German Democratic Rep.

[73] Assignee: VEB Kombinat Textima, Karl Marx Stadt, German Democratic Rep.

[21] Appl. No.: 813,319

[22] Filed: Dec. 24, 1985

[30] Foreign Application Priority Data

Mar. 4, 1985 [DD] German Democratic Rep. ... 273732

[51] Int. Cl.[4] ..... D04B 23/06

[52] U.S. Cl. ..... 66/84 A; 66/85 A

[58] Field of Search ..... 66/84 A, 85 A

[56] References Cited

U.S. PATENT DOCUMENTS

| | | | |
|---|---|---|---|
| 3,523,432 | 8/1970 | Vajda et al. | 66/85 A |
| 3,705,503 | 12/1972 | Skopalik et al. | 66/84 A |
| 3,756,043 | 9/1973 | Kemter | 66/84 A |
| 3,771,330 | 11/1973 | Carman | 66/84 A |
| 4,123,920 | 11/1978 | Bassist | 66/84 A |

*Primary Examiner*—Ronald Feldbaum

*Attorney, Agent, or Firm*—Jordan and Hamburg

[57] ABSTRACT

A flat-weft knitting machine for producing a weft-and-warp-knit fabric, e.g., a stitch knitting machine, employs a weft yarn insertion device, which moves backward and forward, for constantly guiding a continuous thread or yarn group. The insertion device transfers one weft yarn group of the yarn group to first and second weft yarn conveyor means. The weft yarn group is then separated from the insertion device and the yarn group. The weft yarn group thus has free ends at both ends and is then conveyed by the weft yarn conveyor means to a looping point, for connection with loop-forming warp yarns to form a fabric.

29 Claims, 17 Drawing Figures

METHOD AND FLAT WARP-KNITTING MACHINE FOR THE PRODUCTION OF A WEFT-AND-WARP-KNIT FABRIC

BACKGROUND OF THE INVENTION AND RELATED ART STATEMENT

An apparatus for feeding filling threads to a warp-knitting machine (DE-OS No. 2,134,022) is known.

In a flat weft-knitting machine, in particular, a stitch-knitting machine, for the production of a weft-and-warp-knit fabric, a continuous thread or a yarn group is constantly guided in a weft yarn insertion device. The weft can be moved back and forth, which yarn insertion device threads the yarn group from a first weft yarn conveyor means into a second weft yarn conveyor means, during which one weft yarn group of the yarn group is transferred by the weft yarn insertion device to the conveyor means as well as separated from the weft yarn insertion device and the yarn group. After this phase, the weft yarn group has free ends on both sides, so that the weft yarn conveyor means subsequently convey the weft yarn group to a looping point at which the weft yarns are connected to loop-forming warp yarns to form a fabric.

The weft yarn insertion device of the apparatus, however, is only capable of depositing in one forward-passing course one weft yarn group in weft yarn conveyor means. The backward-passing course or return movement of the insertion device occurs without the deposit of a weft yarn in the conveyor means.

With the known apparatus, at the start of each effective forward-passing course of the weft yarn insertion device, it is necessary for the free weft yarn ends to be re-inserted again into the weft yarn conveyor means, in order to hold the yarn ends tightly against the lifting movement of the insertion device.

For this reason, it is necessary to provide the weft yarn insertion device with relatively complicated yarn trapping means.

The inefficiency of the backward-passing course causes either a low conveying speed of the weft yarn conveyor means or an excessively high lifting speed of the weft yarn insertion device when a high conveyor speed is employed. Both phenomena have considerable disadvantages.

Equipping the weft yarn insertion device with yarn trapping means creates additional mass which has to be moved and which increases the costs of the drive. Furthermore, constant reinsertion of the yarn ends in the weft yarn conveyor means introduces functional uncertainties. This is disadvantageous.

The aim of the invention is to overcome the above-mentioned disadvantages and to assure sufficient reliability of the machine at high operating speed.

SUMMARY OF THE INVENTION

The object of the invention is to provide a method and a flat warp-knitting machine, whereby each movement of the weft yarn insertion device triggers the transfer of a finite weft yarn group to a weft yarn conveyor means while the yarns which are to be pulled off a supply location are constantly kept in readiness in the vicinity of the weft yarn conveyor means.

The object of the invention is achieved by a method and apparatus whereby before the weft yarn group is transferred to the weft yarn conveyor means, the beginnings of the weft yarn group are auxiliarily gripped as well as tightly held by a first, separate weft yarn holding device. Subsequently, at a distance from the first weft yarn holding device, the weft yarn group is auxiliarily gripped as well as tightly held at a distance from the beginnings by a second, separate weft yarn holding device. Thereafter, the weft yarn group located between the first and second weft yarn holding devices is taken over by weft yarn conveyor means. After taking over of the weft yarn group by the weft yarn conveyor means, the weft yarn group is separated from the second weft yarn holding device and from the weft yarn insertion device in the vicinity of the second weft yarn holding device, while the first weft yarn holding device almost simultaneously releases the beginning of the weft yarn group. The weft yarn conveyor means subsequently transport the taken-over weft yarn group to the looping point. The weft yarn group which is auxiliarily held in the second weft yarn holding device is then transferred to the first weft yarn holding device, where it is auxiliarly grasped and held tightly. Subsequently, the new weft yarn group located between the weft yarn holding devices is taken over by the weft yarn conveyor means. After taking over of the new weft yarn group by the weft yarn conveyor means, this weft yarn group is separated from the first weft yarn holding device and from the weft yarn insertion device in the vicinity of the first weft yarn holding device, and the second weft yarn holding device releases the weft yarn group approximately simultaneously. The weft yarn conveyor means subsequently transport the weft yarn group which has been taken over to the looping point. The above-described method steps are repeated as often as desired, and each weft yarn is released from the weft yarn conveyor means after it has been entered into the loop-forming warp yarns.

A machine especially suited for the execution of the above-mentioned method is characterized in that a weft yarn holding device is assigned to each of the two weft yarn conveyor means, outside of their intermediary space. The weft yarn holding device is located below the movement plane of the weft yarn insertion device. A cutting device is provided between each conveyor means as well as the assigned weft yarn holding device.

As a result of the present invention, efficiency of the weft yarn insertion device is attained during each movement. Because of the arrangement and functions of the weft yarn holding devices, a constant readiness of the yarns to be pulled off is assured.

BRIEF DESCRIPTION OF THE DRAWINGS

The invention will be understood better by reference to the accompanying drawings, in which.

The drawings show the following.

DETAILED DESCRIPTION OF THE PREFERRED EMBODIMENT

Figure 1:
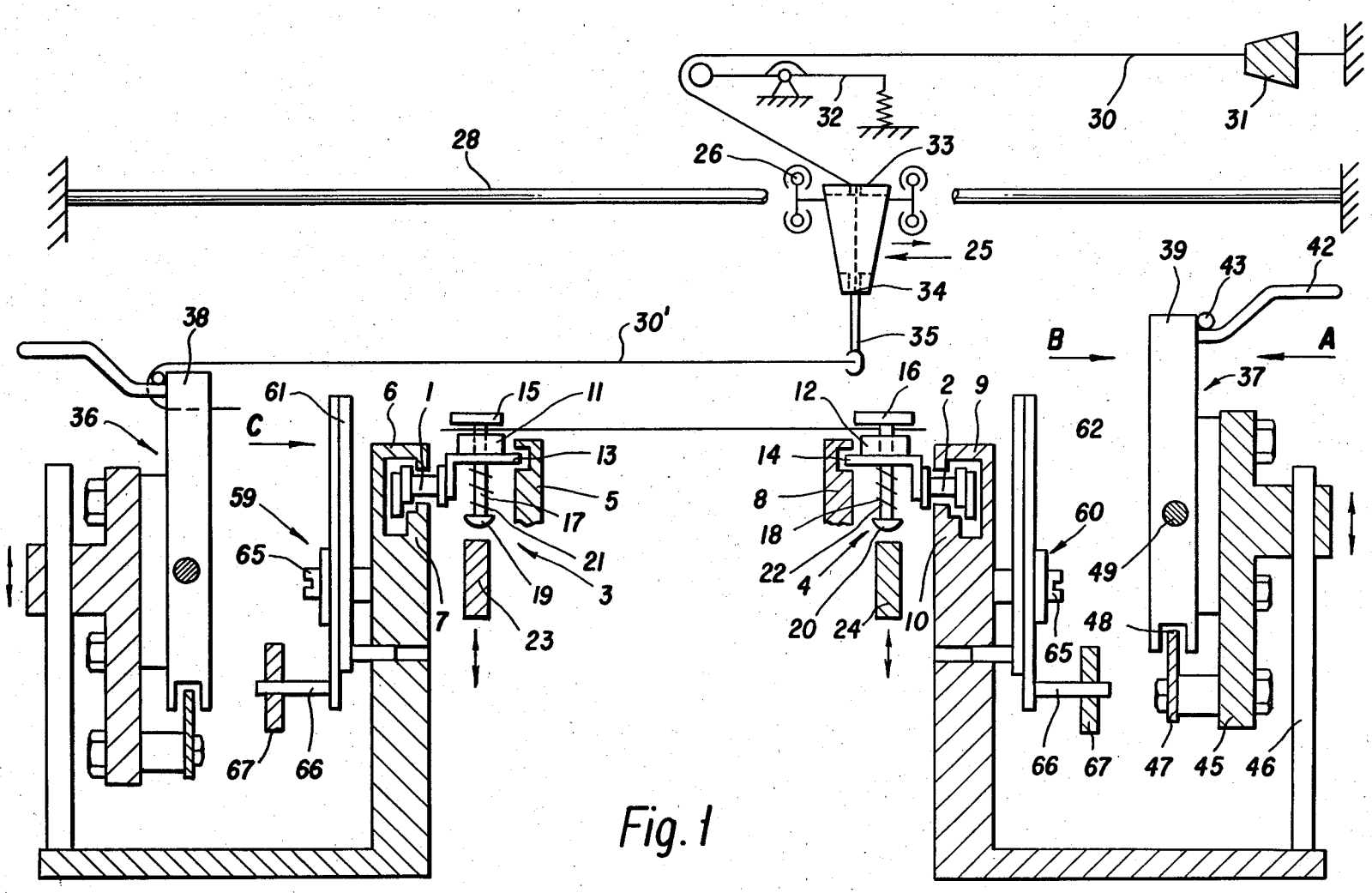
FIG. 1 is a side elevation cross-sectional view of the weft yarn insertion device, the weft yarn conveyor means and the weft yarn holding device of the present invention—shown from the perspective of the looping point.

As shown in FIG. 1, two endless weft yarn conveyor means 1, 2 are arranged at a certain spacing in relation to each other. Both conveyor means 1, 2 move entirely synchronized and continuously to the looping point. In reference to FIG. 1, the forward going course toward the looping point represents a movement of the conveyor means 1, 2 in the perpendicular direction out of the plane of the drawing. A multitude of yarn trappers 3, 4 are fastened on the weft yarn conveyor means 1, 2 at even spacings. There are always provided two facing yarn trappers 3, 4 at approximately right angles to the movement direction of the conveyor means 1, 2. The weft yarn conveyor means 1 is guided by the guide rails 5, 6 and 7, whereas the conveyor means 2 is received by the guide rails 8, 9 and 10. Each yarn trapper 3, 4 has a trapper bottom part 11, 12, which is fastened to the angular butt strap 13, 14, and a trapper top part 15, 16, which is movably guided by its push rod 21, 22 in the bottom part 11, 12. Via the attachment 19, 20, a pressure spring 17, 18 presses the trapper top part 15, 16 against the trapper bottom part 11, 12, thereby holding a yarn inserted between the trapper parts 11, 15 or 12, 16. Under the push rod 21, 22, there is arranged a bar 23, 24 which is movable in the vertical direction. Each of these bars 23, 24 receives its movement from a cam plate which is not shown and which is connected to the machine drive. The cam plate transmits the movement by means of a lever system 23 *a, b, c* or 24 *a, b, c* (FIG. 8) to the bars 23, 24 which are assigned to each of the weft yarn conveyor means 1, 2. A vertical movement of a bar 23, 24 in the upward direction causes an opening of the yarn trapper 3 or 4. The bars 23, 24 are of such dimensions that, simultaneously, at least as many yarn trappers 3, 4 are opened as there are weft yarns belonging to a weft yarn group.

Above the two weft yarn conveyor means 1, 2, there is provided a weft yarn insertion device 25 which can be moved back and forth approximately perpendicular in relation to the movement direction of the weft yarn conveyor means 1, 2. The weft yarn insertion device 25 performs its back and forth movements by means of rollers 26, 27 (FIG. 2) on two fixedly arranged rods 28, 29. As shown in FIG. 1, a continuous thread 30 or a yarn group 30 is constantly guided by the weft yarn insertion device 25 unwinding of the thread or yarn takes place from stationary spools 31 via a joint yarn storage 32. The weft yarn insertion device 25 comprises yarn guide means 33, 34 and elongated yarn guides 35. The spacing of the yarn guides 35 in relation to each other corresponds to the spacing of the yarn trappers 3, 4, which the latter have in relation to each other on their weft yarn conveyor means 1, 2.

Figure 2:
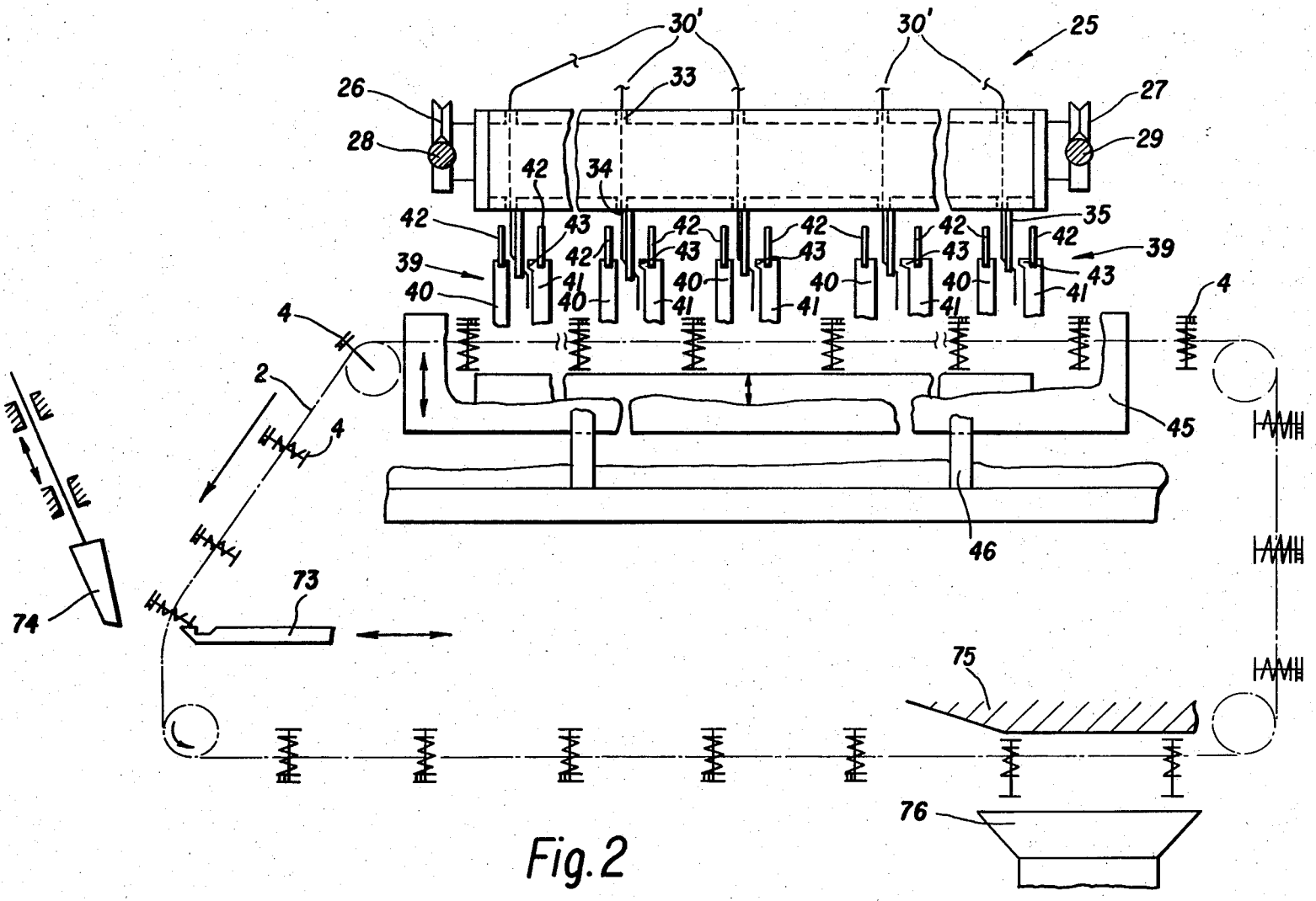
FIG. 2 is a side elevation view of the device shown in FIG. 1, additionally showing the course of the conveyor means and open yarn trapper means, taken along the direction of the arrow A of FIG. 1.
Figure 3:
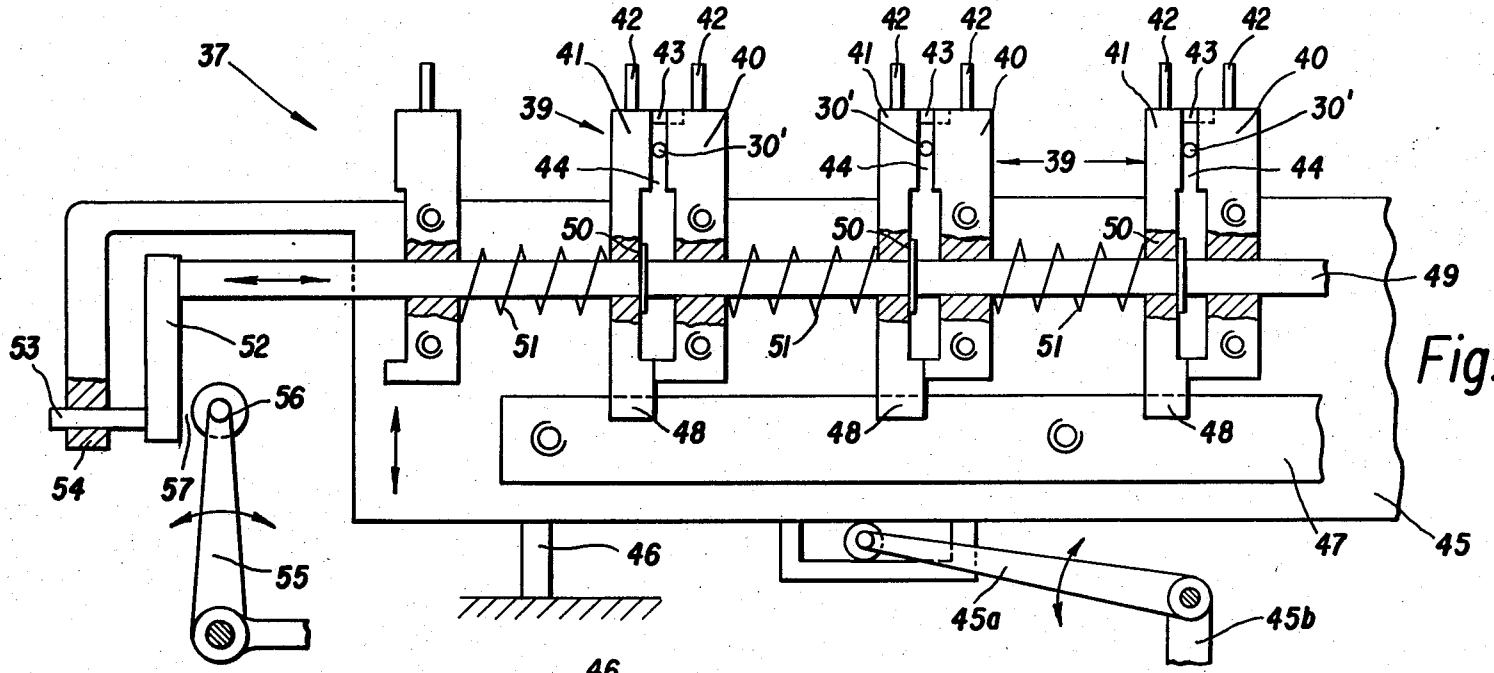
FIG. 3 is a side elevation view of the weft yarn holding device shown in FIG. 1, taken along the direction of the arrow B of FIG. 1, showing closed yarn trappers.

Outside of the intervening space between the weft yarn conveyor means 1, 2 and below the plane of the movement of the weft yarn insertion device 25, there is assigned to each conveyor means 1, 2 a weft yarn holding device 36, 37. Weft yarn holding device 36, 37 carries a yarn trapper means 38, 39 for each weft yarn 30′ of a simultaneously inserted weft yarn group 30′ inserted by the weft yarn insertion device 25 during a back and forth course. The two weft yarn holding devices 36, 37 with the yarn trappers 38, 39 and drives have the same construction, so that further description of these means can take place by describing one side of the machine. For this purpose the side of the weft yarn holding device 37 has been selected for description. As shown in FIGS. 2 and 3, a yarn trapper means 39 is formed by a fixed trapper leg 40 and a movable trapper leg 41. The trapper legs 40, 41 are each provided with a yarn guide pin 42 (see also FIG. 1). One of the two trapper legs 40, 41—in the present case, the movable leg 41 was chosen—is advantageously provided with a yarn deflection means 43, which, as shown in FIG. 4, in the closed state of the yarn trapper means 39 covers the gap 44 between the trapper legs 40, 41, i.e., when a weft yarn 30′ is being held between the trapper legs 40, 41.

Figure 4:
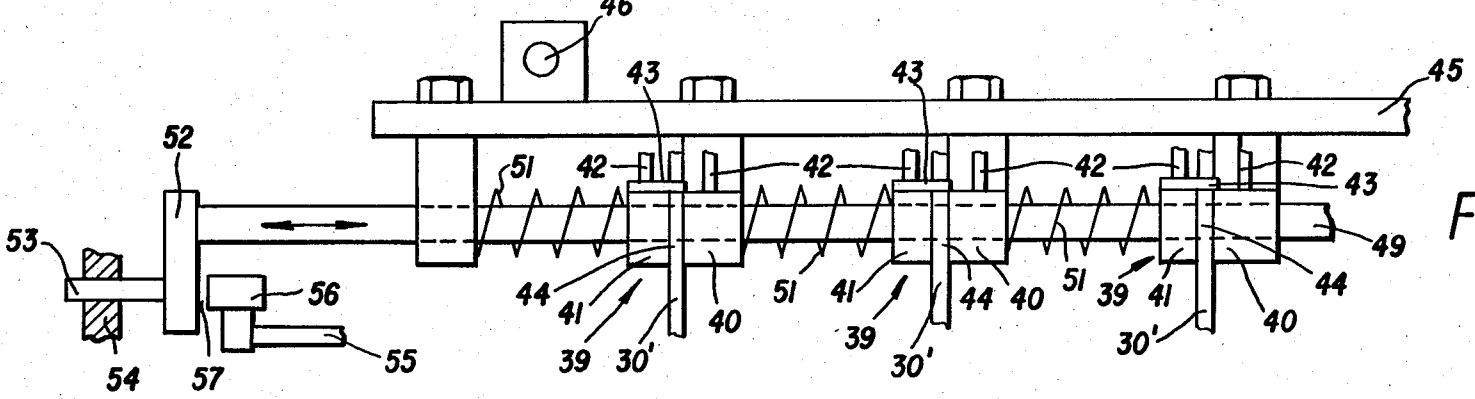
FIG. 4 is a plan view of the device shown in FIG. 3.

The fixed trapper legs 40 of the yarn trapper means 39 are fastened as shown in FIGS. 3 and 4 to a guide plate 45. The latter are in the vertical direction movably supported on columns 46 (see FIG. 1). The vertically movable guide plate 45 is driven via a system of the mechanism elements 45*a*, 45*b* by a cam plate the cam plate is not shown, which in turn being connected to the main drive of the machine. Furthermore, the guide plate 45 supports a guide rail 47, which extends into a groove 48 of the movable trapper leg 41 of the yarn trapper means 39.

As shown in FIGS. 3 and 4, a guide rod 49 is shiftably supported in the fixed trapper legs 40. Guard rod 49 supports the movable trapper legs 41 connected to the rod 49. The guide rail inserted in the grooves 48 safeguards the trapper legs 41 against twisting on the rod 49. For each movable trapper leg 41, there is arranged on the guide rod 49 a detachable ring 50 which cannot be shifted in the axial direction on the rod 49, and a pressure spring 51 arranged as well as pre-tensioned between the fixed trapper legs 40 of an adjacent yarn trapper means 39 and the movable trapper leg 41. The guide rod 49 is equipped at its rear end with an attachment 52 with a pin 53, whose axis is in alignment with the axis of the guide rod 49. In reference to the guide rod 49, the pin 53 is eccentrically arranged and received in a bearing 54, thereby excluding twisting of the rod 49. The control of the axial movement occurs from a cam plate which is not shown and which transmits a corresponding movement to a lever 55, which subsequently acts via a roller 56 upon the guide rod 49. Rotation of the lever 55 in the counter-clockwise direction shifts the guide rod 49 towards the left whereby, via the rings 50, the movable trapper legs 41 are also shifted to the left against the effect of the pressure springs 51, thus causing the opening of the yarn trapper means 39. Rotational movement of the lever 55 in the clockwise direction moves guide rod 49 to the right by the pressure springs 51 via the movable trapper legs 41 and the rings 50, thus causing the closing of the yarn trapper means 39. Because of a gap 57 between the attachment 52 and the roller 56 at closed yarn trapper means 39, and because of the fact that a pressure spring 51 is acting upon each movable trapper leg 41, each yarn trapper means 39 is, practically by itself, or independently of the other trapper means 39, completely closed. The gripping effect of the yarn trapper means 39, therefore, is extensively unaffected by gauge fluctuations of the weft yarns 30' and by production tolerances.

Figure 6:
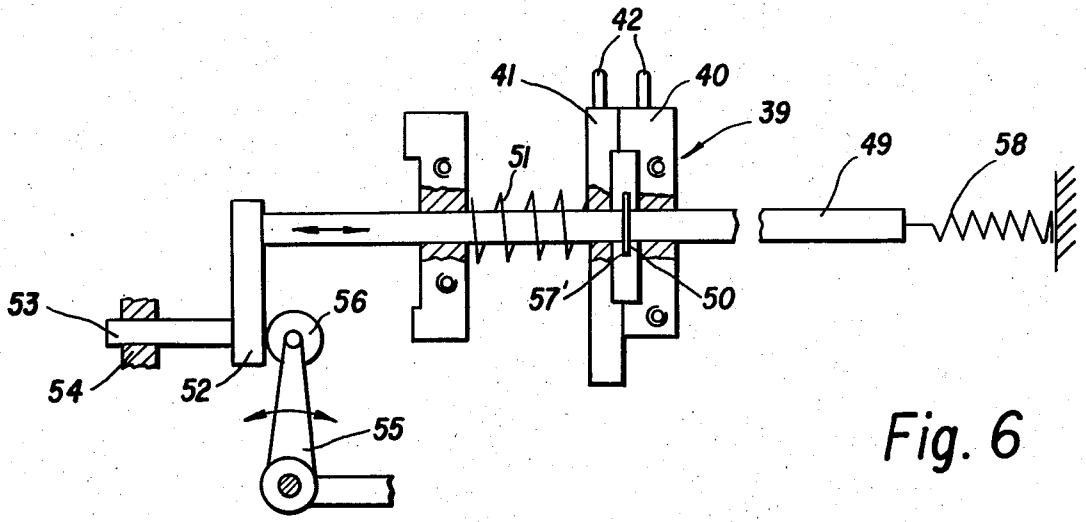
FIG. 6 is a side elevation view illustrating a modification of the weft yarn holding device of FIG. 3.
Figure 7:
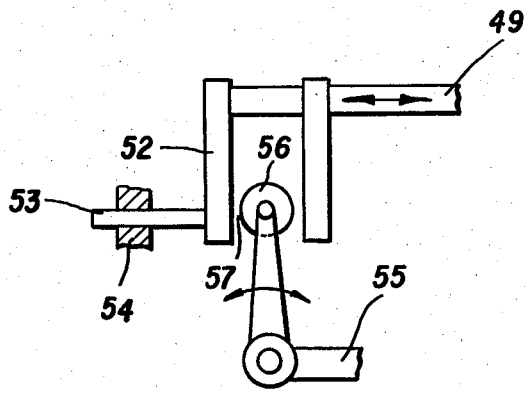
FIG. 7 is a side elevation view illustrating another modification of the weft yarn holding device of the present invention.

It is also possible that, in addition to the pressure springs 51, another spring 58 as shown in FIG. 6, centrally acts upon the guide rod 49. In this case, the roller 56 always makes contact with the attachment 52, and the required gap 57' occurs between the ring 50 and the movable trapper leg 41. Both exemplified embodiments for movement means of the guide rod 49 (FIGS. 3, 4 and 6) have in common that the opening of the yarn trapper means 39 occurs form-closed and the closing force-closed. However, it is also possible to drive the guide rod 49 form-closed in both movement directions, as shown in FIG. 7. In this variant, when the yarn trapper means 39 are closed, there has to be present at least a gap 57 between the roller 56 and the attachment 52, whereby it can also be quite advantageous, if, in addition, a corresponding gap is provided between the rings 50 and the movable trapper legs 41.

From the three examples for the axial movement of the guide rod 49, it should also be appreciated that the vertical position of the weft yarn holding device 37 does not influence the shifting of the guide rod 49, because the effectiveness of the arm of the lever 55 is not dependent on the vertical position of the attachment 52 as long as the latter remains in the area of the lever 55.

Figure 5:
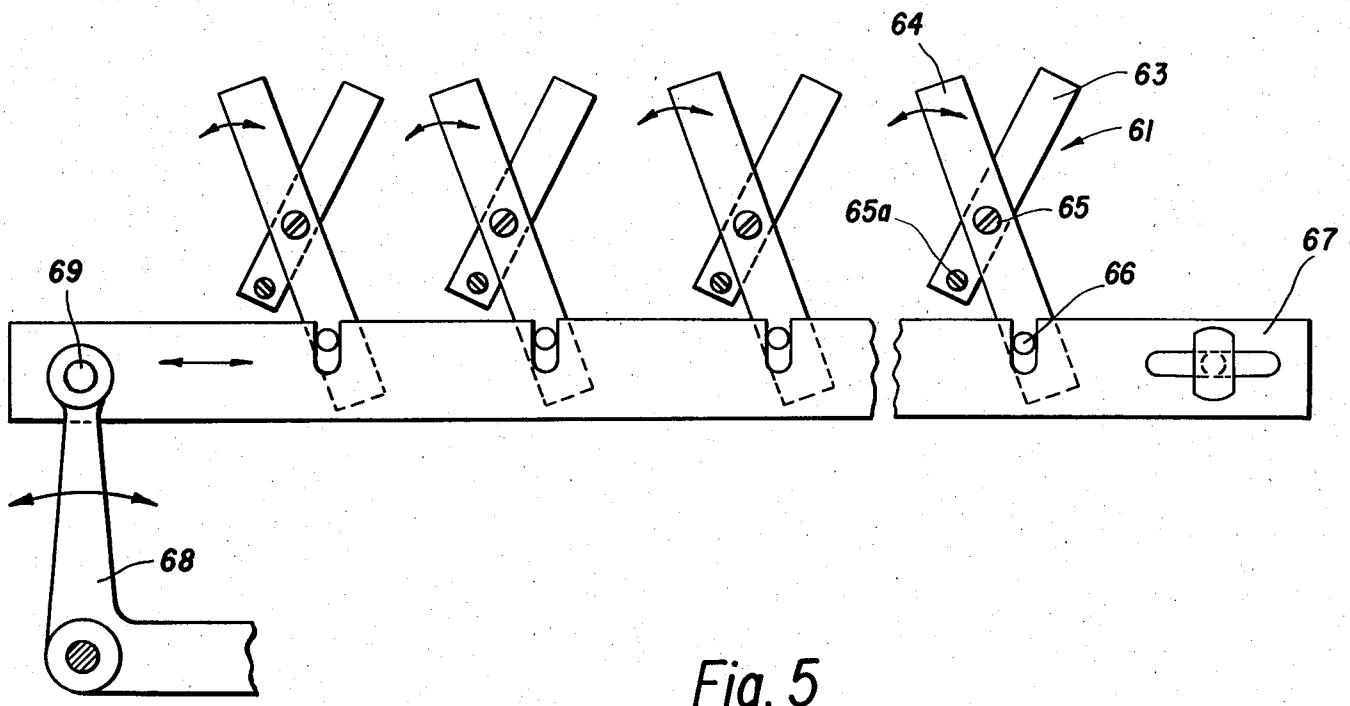
FIG. 5 is a side elevation view of a cutting device with operating means, taken along the direction of the arrow C of FIG. 1.

As shown in FIG. 1, the flat warp-knitting machine is equipped on both sides between the weft yarn conveyor means 1 or 2 and the weft yarn holding devices 36 or 37 with a cutting device 59, 60. Each cutting device 59, 60 comprises a pair of scissors 61, 62 for each weft yarn 30' of the weft yarns 30' inserted per forward and backward course of the weft yarn insertion device 25. The spacing between the scissors in relation to each other on each side of the machine corresponds to the spacing of the yarn guide 35 of the weft yarn insertion device 25. The two cutting devices 59, 60, scissors 61, 62 and associated drive are principally the same, so the following explanation refers to only one of cutting devices 59, 60. As shown in FIG. 5, the scissors 61 are formed by a fixed scissor leg 63 and a movable scissor leg 64. By means of plug bolts 65, 65*a*, the fixed scissors leg 63 is mounted. The bolt 65 also serves as a bearing for the movable leg 64. On each scissors' leg 64 is fastened a pin 66 which, for the purpose of the movement of the loose leg 64, is guided in a recess of a rod 67. The rod 67 is moved by a cam plate, which is not shown, via a lever 68 and a bolt 69.

Hereinafter, the method of operation of the described flat warp-knitting machine will be explained in detail.

FIGS. 9 to 16 are schematic flow charts of the process steps performed by the weft yarn insertion device 25, th weft yarn holding device 36, 37, the weft yarn conveyor means 1, 2 and the cutting devices 59, 60 in conjunction with associated means. The reference numerals thereof correspond to those in FIG. 1.

Figure 9:
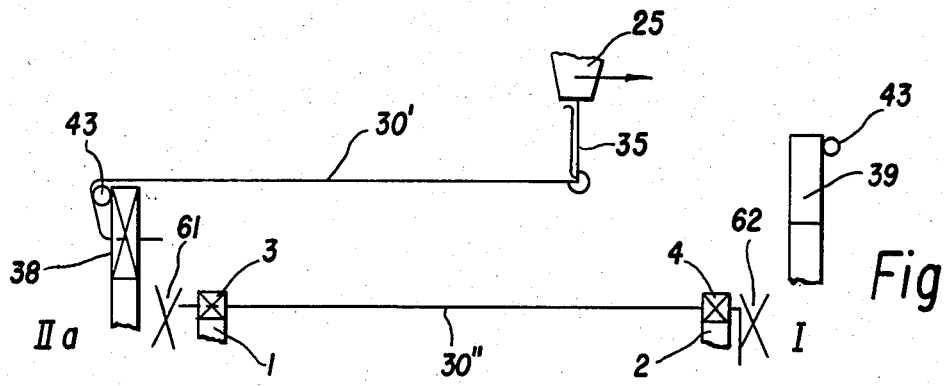
FIGS. 9 to 16 are schematic diagrams of the process steps of the present invention, showing the weft yarn insertion and weft pick-up by the weft yarn conveyor means.
Figure 10:
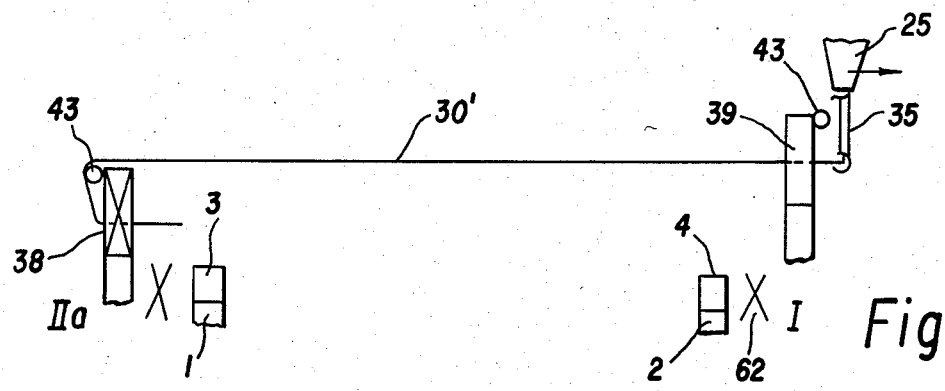

As can be seen from FIGS. 9 and 10, a beginning of a weft yarn group 30' is held in the yarn trapper 38. The yarn trapper means 38 thereby assume a position 11*a* above the plane of the weft yarn conveyor means 1, 2. Also above the plane of the conveyor means 1, 2 are in this phase the yarn trapper means 39. The latter are in the position I, which is further removed from the plane of the conveyor means 1, 2 than the position 11*a* of the yarn trapper means 38. In relation to the weft yarn insertion device 25, the side of the yarn trapper means 38 is designated in this phase as weft feed side, and the side of the yarn trapper means 39 as the weft delivery side. The weft yarn group 30' is now moving from the weft yarn feed side (left) to the weft delivery side (right). The yarn guides 35, which are guiding the weft yarns 30', at arrival at the weft delivery side, are traveling through the previously opened yarn trapper means 39. Because of the holding of the weft yarn beginnings in the yarn trapper means 38 and the movement of the weft yarn insertion device 25, the weft yarn group 30' is pulled off the spools 31 (FIG. 1) and is placed above the weft yarn conveyor means 1, 2 across the entire working width. If one assumes, according to FIG. 9, that a group of finite weft yarns 30'' has previously been transferred into the yarn trappers 3, 4 of the conveyor means 1, 2, then this "old" weft yarn group 30'' together with the conveyor means 1, 2 is now moving towards the looping point (which is an imagined, not illustrated movement out of the plane of the drawing, extending in the direction towards the observer), whereby the yarn trappers 3, 4 are closed. The "old" weft yarn group 30'' has on the weft feed side a shorter yarn end than on the weft delivery side, where the yarns ends tend to be somewhat longer. The cause of this will be explained later. In FIG. 10, furthermore, it was also assumed that the "old" weft yarn group 30'' has moved out of the area of the yarn trapper means 38, 39 (seen from the top of the trapper means 38, 39), in order to make room for a "new" weft yarn group 30'. This means also that in the meantime free, opened yarn trappers 3, 4 have been advancing with the weft yarn conveyor means 1, 2 and have arrived under the "new" weft yarn group 30'. Furthermore, all speed relationships and path relationships have been synchronized in such a way that an "old" weft yarn group 30'' is advancing so far with the weft yarn conveyor means 1, 2 at each forward and backward course of the weft yarn insertion device 25 that the following "new" weft yarn group 30' can follow at the desired spacing and is provided for this purpose with yarn trappers 3, 4 which are opened and ready to receive.

Figure 8:
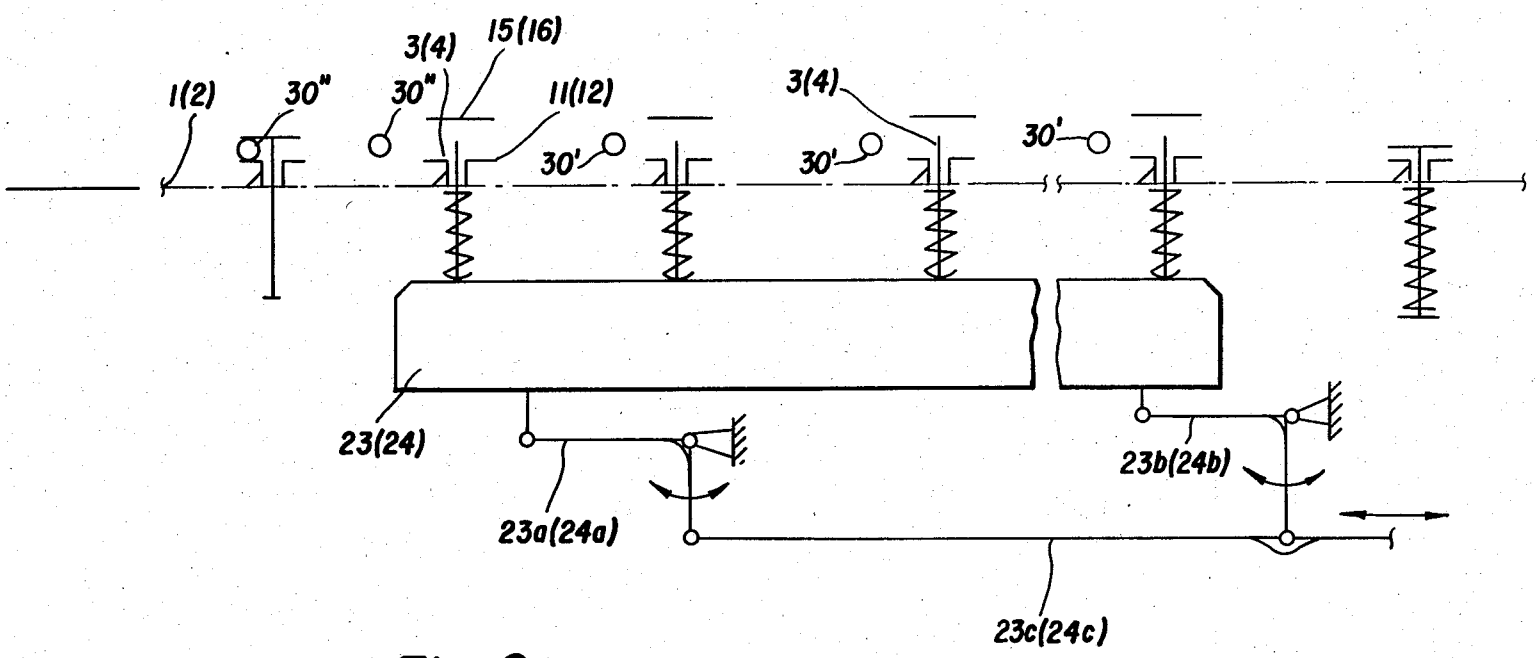
FIG. 8 is a schematic side view of operating means for yarn trappers of a weft yarn conveyor means of the present invention.
Figure 11:
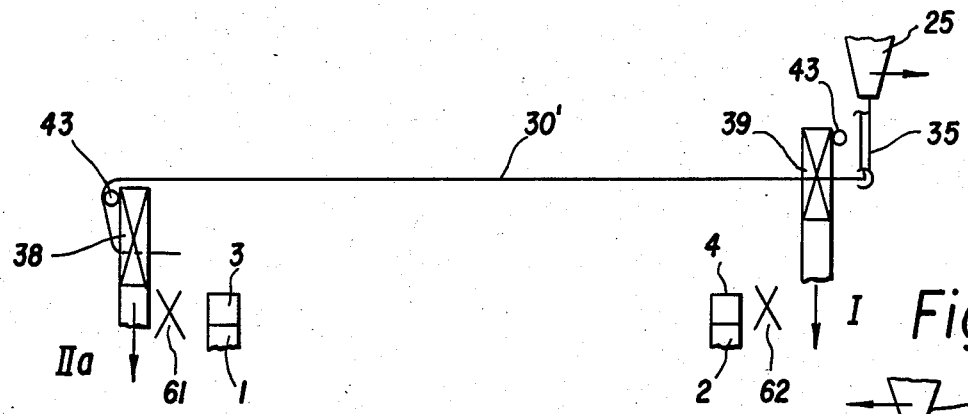
Figure 12:
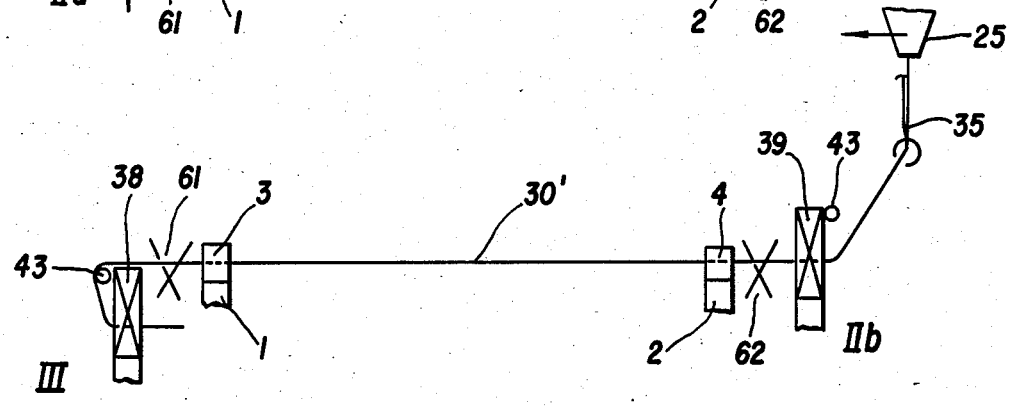
Figure 13:
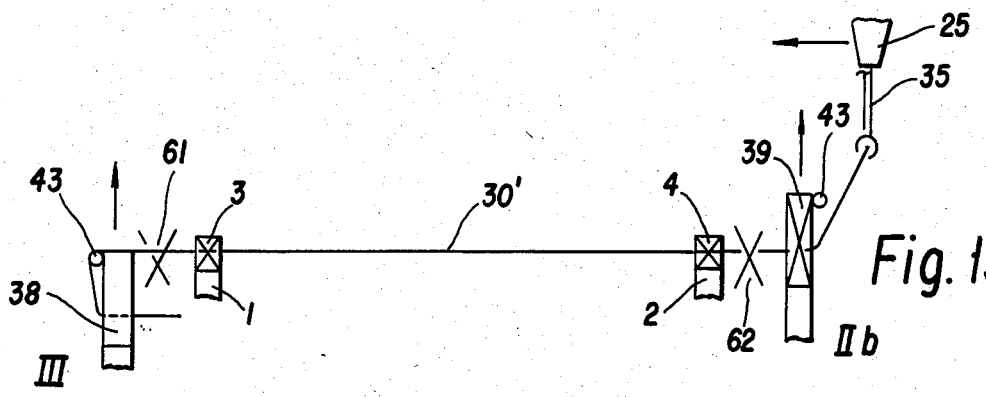

As soon as the yarn guides 35 have traveled through the yarn trapper means 39, the latter close and, subsequently, the yarn trapper means 38, 39 are simultaneously lowered on both sides (FIG. 11). The "new" weft yarn group 30' enters thus into the action area of the yarn trappers 3, 4 (FIG. 8), which are open at this time, and into the spread scissors 61, 62 (FIG. 5), as shown in FIG. 12. In reference to this, FIG. 8 shows in whay way the "new" weft yarn group 30' is gripped by the bottom parts 11, 12 and the top parts 15, 16 of the trappers of the yarn trapper means 34. The yarn trapper means 38 thus reach from the position 11*a* via the plane of the weft yarn conveyor means 1, 2 their lowest position III, which is approximately at the height of the conveyor means 1, 2. The yarn trapper means 39, on the other hand, are lowered into the position 11*b*, which is above the plane of the conveyor means 1, 2, whereby, however, the weft yarn group 30' is guided into the plane of the yarn trapper 3, 4, as has been described above.

After the weft yarn group 30' has been gripped by the yarn trappers 3, 4, the latter are closed as shown FIG.

13 and, subsequently, the yarn trapper means 38 are opened and the weft yarn group 30′ is cut by means of scissors 62 on the weft delivery side or on the side of the yarn trapper means 39. The cutting occurs between the yarn trappers 4 and the yarn trapper means 39, whereby the latter are kept closed. The opening of the yarn trapper means 38 without operating the scissors 61 causes a somewhat longer yarn end of the weft yarn group 30′ at the yarn trappers 3 and the emptying of the yarn trapper means 38, whereas the yarn end being created at the yarn trappers 4 is shorter due to the operation of the scissors 62. In FIG. 9, the same phenomenon occurred with reversed sides, because the "old" weft yarn group 30″ was being created in the opposite cycle, which is repeated from the start in FIG. 14 as a sequence to FIG. 13. Therefore, the functions of the sides of the yarn trapper means 38, 39 are interchanging. The side of the trapper means 38 functions in the subsequent cycle as weft delivery side and the side of the trapper means 39 as weft feed side. Thus occurs the following side-reversing work cycle of the FIGS. 9 to 13.

Figure 14:
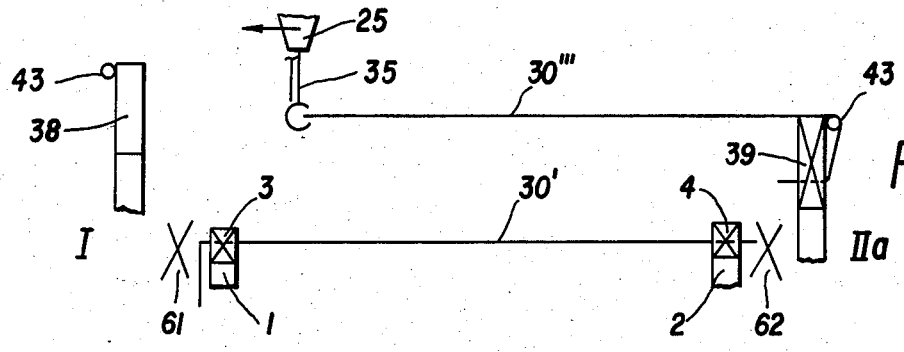
Figure 15:
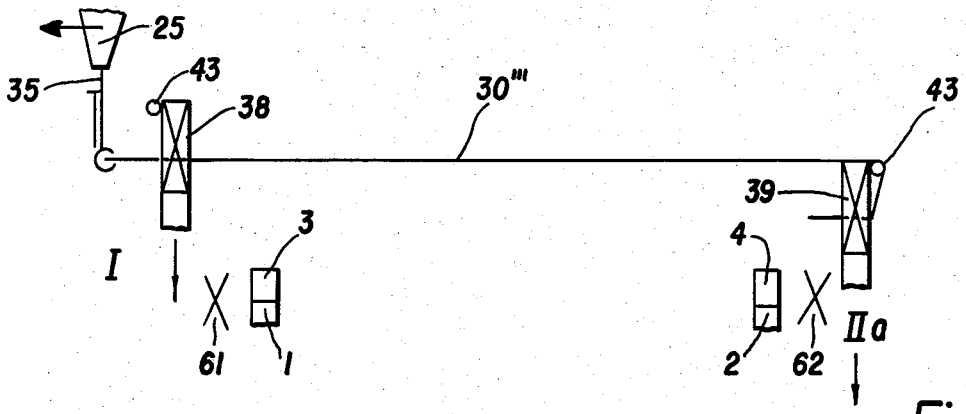
Figure 16:
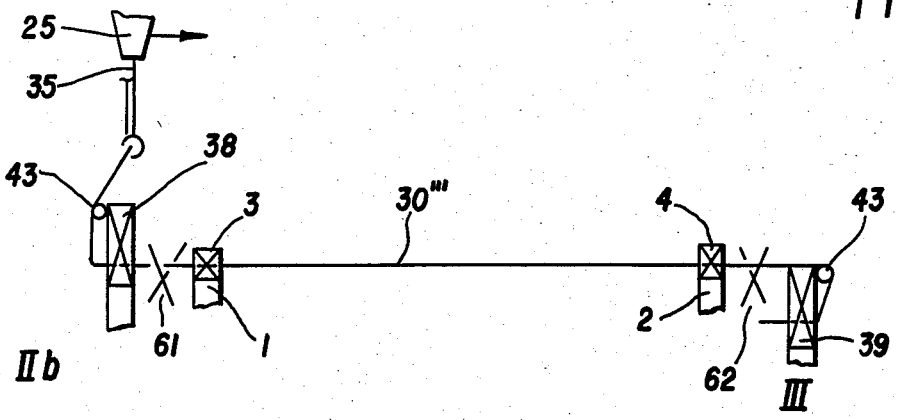

The weft yarn insertion device 25 of FIG. 14 is moving toward the new weft delivery side (yarn trapper means 38), and the yarn trapper means 39 have advanced upwards into a position 11*a*, whereby a beginning of another "new" weft yarn group 30‴ is held by the yarn trapper means 39. Before the weft yarn insertion device 25 reaches the yarn trapper means 38, the height thereof has also been adjusted, in that the highest position I has become the working position, in which the weft yarn group 30‴ is being received by the weft yarn insertion device 25. In the yarn trappers 3, 4 of FIG. 14, there is still present the "second-oldest" weft yarn group 30′, which is on the way to make room for the "new" weft yarn group 30‴, which has then taken place in the sense of FIG. 15. As soon as the yarn guides 35 have traveled through the yarn trapper means 38, the latter close, and both yarn trapper means 38, 39 are subsequently lowered so that the weft yarn group 30‴ is received by the yarn trappers 3, 4 as previously described. The yarn trapper means 38 have thereby assumed the position 11*b* and the yarn trapper means 39 the lowest position III. Subsequently, the yarn-trapper means 39 are opened and the weft yarn group 30‴ is cut by means of the scissors 61.

Subsequently, another movement cycle starts analogous to the FIGS. 9 to 13, which can be repeated as often as desired.

Figure 17:
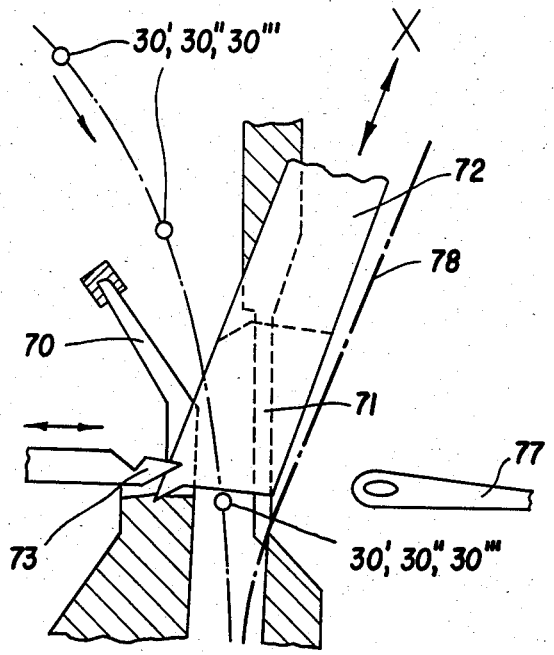
FIG. 17 is a simplified cross-sectional view of the looping point of the present invention.

The weft yarns 30′, 30″, 30‴, which have arrived at the looping point, are connected there (FIG. 17) by means of the knitting needles 73 and the eye needles 77 as well as the loop-forming warp yarns into a fabric—a weft-and-warp-knit fabric. This can occur with several rows of eye-needles or with one row, whereby the known warp-knitting constructions and their combinations can be used. It is also possible to tie-in loose weft yarns or pattern elements running along the weft yarns 30′, 30″, 30‴ approximately at a right angle in relation to them or transversely. With the present invention it is further intended to produce a fabric consisting of weft yarns 30′, 30″, 30‴, a backing fabric 78 added to the latter and the weft yarns connecting the above-mentioned elements. For this purpose, the backing fabric 78 is conveyed to the machine in front of the support needles 71, so that the backing fabric enters between the eye needles 77 and the support needles 71 into the looping point. Suitable backing material includes a woven fabric, a knit fabric, a nonwoven fleece, a plastic sheet, a felt web or a spunbonded nonwoven fleece.

In order to tie-in each weft yarn 30′, 30″, 30‴ in a predetermined row, at several locations between knocking-over bits 70, the knitting needles 73 and the support needles 71, there are provided conveyor sinkers 72, which are mounted on a common bar which is not shown. The sinkers 72 carry out lifting movements in the direction X shown in FIG. 17, which are directed upward and downward. During the downward movement, the sinkers 72 grasp the nearest weft yarn 30′, 30″, 30‴ and insert it in a row, wherein the weft yarn 30′, 30″, 30‴ is brought behind the knitting needles 73. The sinkers 72 remain in the lowest position until the points of the knitting needles 73 protrude out of the the support needles 71, so that the weft yarn 30′, 30″, 30‴ can no longer evade. The described work cycle is carried out with each weft yarn 30′, 30″, 30‴. As a drive for the bar of the conveyor sinker 72, a standard cam plate drive or crank mechanism drive can be used. The highest position of the sinkers 72 is indicated in the drawings in dotted lines and the lowest position in solid lines. According to FIG. 2, at the looping point at both inner sides of the weft yarn conveyor means 1, 2, there is arranged a knife 74 at a bar of the conveyor sinkers 72. Due to the lifting movement of the bar, as soon as a weft yarn 30′, 30″, 30‴ is tied-in in a row, it is separated from the yarn trappers 3, 4 of the conveyor means 1, 2, in order to free the weft-and-warp-knit fabric immediately from the conveyor means 1, 2. Subsequently, each newly produced piece of fabric is wound up. The yarn trappers 3, 4, arrive after the looping point on a curve 75, which is present on both sides, whereby the clamps 3, 4 are being opened and the still present yarn ends can be extracted by a suctioning device 76 provided on each side.

Within the framework of the present invention, there can also be seen an inclined arrangement of the rods 28, 29 of the weft yarn insertion device 25 in order to convey to the looping point weft yarn groups 30′, 30″, 30‴ which have been transferred transversely to the weft yarn conveyor means 1, 2 and have been retained by the latter. For example, there could also be provided two weft yarn insertion devices 25, of which one is moving back and forth perpendicularly and the other transversely in relation to the weft yarn conveyor means 1, 2.

What is claimed is:

1. In a method for the production of a warp-and-weft knit fabric comprising:

constantly guiding a continuous thread or yarn group in a weft yarn insertion device moving back and forth, the insertion device inserting the yarn group between a first weft yarn conveyor means and a second weft yarn conveyor means;

transferring a weft yarn group of the yarn group to the conveyor means and separating the weft yarn group from the insertion device and yarn group, whereby the weft yarn group has two free ends;

conveying the weft yarn group to a looping point; and connecting the weft yarn group to loop-forming warp yarns to form a fabric; the improvement comprising performing the following steps a plurality of times:

auxiliarily grasping and holding tightly, prior to transfer to the conveyor means, beginnings of the weft yarn group in a first weft yarn holding means;

auxiliarily grasping and holding tightly, prior to transfer to the conveyor means, the weft yarn group at a point other than the beginnings in a second weft yarn holding means;

separating the weft yarn group from the second weft yarn holding means and the insertion device in the vicinity of the second holding means after the weft yarn group being auxiliarily grasped and held tightly by the holding means has been transferred to the weft yarn conveyor means;

approximately simultaneously freeing the beginnings of the weft yarn group from the first weft yarn holding means;

transferring the weft yarn group being grasped and held tightly by the second holding means to the first holding means, after the weft yarn group having free ends has been conveyed to the looping point, to auxiliarily grasp and hold the weft yarn group tightly in the first holding means and to form a new weft yarn group between the holding means;

transferring the new weft yarn group to the weft yarn conveying means;

separating the new weft yarn group from the first holding means and the insertion device in the vicinity of the first holding means after the new weft yarn group being auxiliarily grasped and held tightly by the holding means has been transferred to the weft yarn conveying means;

approximately simultaneously freeing the new weft yarn group from the second holding means; and conveying the new weft yarn group to the looping point for connection to the loop-forming warp yarns.

2. Method according to claim 1, characterized in that, while a weft yarn group is being transferred from one weft yarn holding device to another, the weft yarn holding device arranged in the particular movement direction of the weft yarn group moves into a highest position to receive a new weft yarn group and the weft yarn holding device holding the weft yarn group is lifted into a first center position.

3. Method according to claim 2, characterized in that the another weft yarn holding device towards which the weft yarn group is moving is subsequently lowered from the highest position to a second center position when the weft yarn group has been grasped by the another weft yarn holding device while the one weft yarn holding device moves from the first center position to a lowest position.

4. Method according to claim 3, characterized in that the one weft yarn holding device from which the weft yarn group is being transferred is moved out of the second center position up into the first center position as soon as the weft yarn group in the vicinity of the weft yarn insertion device has been cut off, whereby the first center position is maintained until the weft yarn group has reached the another weft yarn holding device.

5. Method according to claim 4, characterized in that during the time the one weft yarn holding device is moved out of the second center position up into the first center position, the another weft yarn holding device intended to receive the weft yarn group is moved upwards, so that the another weft yarn holding device is shifted from the lowest position into the highest position.

6. Method according to claim 1, characterized in that a weft yarn group is clamped tight by the weft yarn conveyor means before the weft yarn group in the vicinity of the weft yarn insertion device is cut off and freed approximately simultaneously at the opposite weft yarn holding device when the weft yarn insertion device has completed a back and forth movement.

7. Method according to the claim 1 characterized in that a weft yarn group is always transferred to the weft yarn conveyor means when the previous group has a forerunner of a yarn spacing of the weft yarn conveyor means.

8. Method according to the claim 1, characterized in that yarns of the weft yarn group are guided parallel in relation to each other.

9. Method according to the claim 1, characterized in that the weft yarns of the looping point are conveyed at a greater spacing from each other and at a higher speed than the yarn spacing and the unwinding speed of a finished weft-and-warp-knit fabric.

10. Method according to the claim 1, characterized in that a weft yarn is fed for each row of a weft-and-warp-knit fabric.

11. Method according to the claim 10, characterized in that the weft yarns are fed at various spacings.

12. Method according to the claim 11, characterized in that each weft yarn is fed approximately at a right angle to the length or row-wise to the weft-and-warp-knit fabric.

13. Method according to the claim 12, characterized in that the weft-yarns of the looping point are conveyed transversely.

14. Method according to the claim 1, characterized in that, in addition to the weft yarns, there is conveyed to the looping point a backing fabric fed in front of a row of support needles in a space between the support needles and a number of eye needles.

15. Method according to the claim 1, characterized in that, after connecting to the loop-forming warp yarns, the weft yarn ends are cut off from the weft-and-warp-knit fabric and are subsequently suctioned off.

16. Flat warp-knitting machine, in particular a stitch-knitting machine, comprising two driven, endless weft yarn conveyor means and a weft yarn insertion device arranged above the weft yarn conveyor means, the weft yarn insertion device being provided with means for the constant guidance of a continuous thread or a yarn group and being transversely movable back and forth in relation to the conveyor means, the conveyor means conveying weft yarns which have been cut off the yarn group to a looping point and being provided with a number of yarn trappers controllable by operating means, characterized in that to each of the two weft yarn conveyor means, outside of their intermediary space, there is provided a weft yarn holding device below the plane of the weft yarn insertion device, and wherein between each conveyor means and provided weft yarn holding device, there is provided a cutting device.

17. Flat warp-knitting machine according to claim 16, characterized in that the means for guidance of the thread or yarn group comprising a plurality of yarn guides spaced from each other and each weft yarn holding device is provided with a number of yarn trappers spaced from each other and corresponding to the number of yarn guides.

18. Flat warp-knitting machine according to claim 16, characterized in that a system of mechanism elements is provided for moving each weft yarn holding device up and down in the vertical direction.

19. Flat warp-knitting machine according to the claim 16, characterized in that the weft yarn insertion device travels back and forth on rods arranged at a right angle in relation to the weft yarn conveyor means.

20. Flat warp-knitting machine according to the claim 19, characterized in that the rods of the weft yarn insertion device are arranged transversely to the weft yarn conveyor means for inserting a transversely lying weft yarn group into the looping point.

21. Flat warp-knitting machine according to claim 17, characterized in that the yarn trappers of the weft yarn conveyor means are spaced from each other by the same amount as the yarn guides of the weft yarn insertion device and the yarn trappers of the weft yarn holding devices.

22. Flat warp-knitting machine according to claim 21, characterized in that the yarn trappers of the weft yarn holding devices each comprise trapper legs, a yarn guide pin and a yarn transfer means.

23. Flat warp-knitting machine according to claim 17, characterized in that the yarn trappers of the weft yarn holding devices are operated by a guide rod controlled by a cam plate.

24. Flat warp-knitting machine according to claim 17, characterized in that each cutting device comprises a plurality of scissors corresponding to the number of yarn trappers for each weft yarn holding device.

25. Flat warp-knitting machine according to claim 16, characterized in that the operating means for the yarn trappers of the weft yarn conveyor means comprises a lever system pivotally connected to a bar.

26. Flat warp-knitting machine according to claim 16 characterized in that a row of support needles and a row of knitting needles are provided at the looping point, the support needles gripping a plurality of conveyor sinkers, the conveyor sinkers being movable in an upward and downward direction for tying-in each weft yarn in a predetermined row.

27. Flat warp-knitting machine according to claim 16, characterized in that knife means are provided at the looping point for cutting off yarn ends from the weft yarns and an aspirating device is provided after the looping point for leading off the yarn ends.

28. Flat warp-knitting machine according to claim 16, characterized in that several weft yarn insertion devices are provided above the weft yarn conveyor means for traveling back and forth in relation to the conveyor means.

29. Flat warp-knitting machine according to claim 16, characterized in that the weft yarn insertion device travels back and forth at a right angle in relation to the conveyor means.

* * * * *